US008444069B2

(12) United States Patent
Fujino et al.

(10) Patent No.: US 8,444,069 B2
(45) Date of Patent: May 21, 2013

(54) FUEL INJECTION APPARATUS

(75) Inventors: Tomoki Fujino, Okazaki (JP); Jun Kondo, Nagoya (JP); Shu Kagami, Nagoya (JP); Yutaka Miyamoto, Takahama (JP)

(73) Assignee: Denso Corporation, Kariya (JP)

( * ) Notice: Subject to any disclaimer, the term of this patent is extended or adjusted under 35 U.S.C. 154(b) by 209 days.

(21) Appl. No.: 12/752,499

(22) Filed: Apr. 1, 2010

(65) Prior Publication Data

US 2010/0252659 A1 Oct. 7, 2010

(30) Foreign Application Priority Data

Apr. 3, 2009 (JP) ..... 2009-90705

(51) Int. Cl.
*B05B 1/30* (2006.01)

(52) U.S. Cl.
USPC ..... 239/585.1; 123/387; 73/114.45; 73/114.51

(58) Field of Classification Search
USPC ..... 239/585.1, 900; 251/129.09; 137/557; 73/114.43, 114.45, 114.53; 123/387
See application file for complete search history.

(56) References Cited

U.S. PATENT DOCUMENTS

| | | | | |
|---|---|---|---|---|
| 6,598,591 | B2 * | 7/2003 | Lewis | 123/467 |
| 2004/0108395 | A1 * | 6/2004 | Hamada et al. | 239/585.1 |
| 2006/0186365 | A1 | 8/2006 | Hirayama | |

FOREIGN PATENT DOCUMENTS

| | | | |
|---|---|---|---|
| JP | P2007-278139 | A | 10/2007 |
| JP | P2008-64732 | A | 3/2008 |
| JP | 2008-240544 | | 10/2008 |
| JP | P2010-535977 | A | 11/2010 |
| WO | WO 2009/019663 | | 2/2009 |

OTHER PUBLICATIONS

U.S. Appl. No. 12/752,521, Kagami et al., filed Apr. 1, 2010.
Japanese Office Action dated Nov. 6, 2012, issued in counterpart Japanese Application No. 2009-090705 with English translation.

* cited by examiner

*Primary Examiner* — Len Tran
*Assistant Examiner* — Viet Le
(74) *Attorney, Agent, or Firm* — Nixon & Vanderhye, P.C.

(57) ABSTRACT

A fuel injection apparatus includes a body, a nozzle, a pressure control unit, a physical quantity measurement unit, a first terminal, a second terminal, a positioning member, and a resin connector main body portion. The pressure control unit controls opening and closing of the nozzle The physical quantity measurement unit outputs an electric signal in accordance with a physical quantity of high pressure fuel. The first terminal is connected to the pressure control unit. The second terminal connected to the physical quantity measurement unit. The positioning member integrally holds the first terminal and the second terminal and locates the first terminal and the second terminal at predetermined positions. The connector main body portion receives therein the positioning member.

12 Claims, 5 Drawing Sheets

COMPARISON EXAMPLE

FUEL INJECTION APPARATUS

CROSS REFERENCE TO RELATED APPLICATION

This application is based on and incorporates herein by reference Japanese Patent Application No. 2009-90705 filed on Apr. 3, 2009.

BACKGROUND OF THE INVENTION

1. Field of the Invention

The present invention relates to a fuel injection apparatus that injects fuel to an internal combustion engine.

2. Description of Related Art

In a conventional fuel injection system, a rail pressure is detected by a pressure sensor, and the detected pressure of high pressure fuel is sent to an engine ECU. More specifically, the pressure sensor is provided at a common rail that supplies high pressure fuel to a fuel injection apparatus, or the pressure sensor is provided between the common rail and the fuel injection apparatus. Also, the rail pressure indicates pressure of high pressure fuel that is supplied to the fuel injection apparatus.

Also, the fuel injection apparatus has an actuation element (for example, solenoid, piezoactuator) that operates in accordance with control signals received from the engine ECU. The actuation element is actuated in order to control fuel injection (see for example, JP-A-2008-240544).

However, in the above conventional fuel injection system, wire connection between the pressure sensor and the engine ECU is required, and another wire connection between the actuation element and the engine ECU is also required. Thus, operability in the assembly of the fuel injection system to the vehicle is not good disadvantageously.

Thus, in another configuration, the pressure sensor is mounted on the fuel injection apparatus, and the pressure sensor is used to detect the pressure of high pressure fuel introduced to the fuel injection apparatus. As a comparison example, FIG. 6 shows a fuel injection apparatus that has a pressure sensor mounted on the fuel injection apparatus. The fuel injection apparatus includes a body 1001 and a pressure sensor 1006. The body 1001 receives therein an actuation element, and the pressure sensor 1006 is provided on one side of the body 1001. Also, the actuation element has lead wires 1044 that are connected to actuator terminals 1045. Also, electrodes 1063 of the pressure sensor 1006 are connected to sensor terminals 1064. The actuator terminals 1045 and the sensor terminals 1064 are received within a connector portion 1007.

If a dimension of each part of the pressure sensor 1006 varies from product to product in the comparison example, a distance L1 measured between (a) an end surface of the body 1001 and (b) surfaces of the electrodes 1063 of the pressure sensor 1006 in a longitudinal direction of the body 1001 (or in an up-down direction in FIG. 6) may vary from product to product. Due to the variation of the distance L1, positions of the sensor terminals 1064, which are welded to the surfaces of the electrodes 1063, may vary accordingly. As a result, a distance L2 measured between (a) parts of the actuator terminals 1045 connected to respective terminals of an external connector and (b) parts of the sensor terminals 1064 connected to respective terminals of the external connector in the longitudinal direction may vary disadvantageously. As a result, short circuit may occur disadvantageously. Furthermore, in a case, where the dimension of each part of the pressure sensor 1006 is strictly controlled in order to reduce the variation of the distance L2 caused by the variation of the distance L1, the manufacturing cost may increase disadvantageously.

SUMMARY OF THE INVENTION

The present invention is made in view of the above disadvantages. Thus, it is an objective of the present invention to address at least one of the above disadvantages.

To achieve the objective of the present invention, there is provided a fuel injection apparatus that includes a body, a nozzle, a pressure control unit, a physical quantity measurement unit, a first terminal, a second terminal, a positioning member, and a connector main body portion. The body has a high-pressure fuel passage that allows high pressure fuel to flow therethrough. The nozzle has an injection orifice that allows high pressure fuel to be injected therethrough when the nozzle is opened. The pressure control unit controls opening and closing of the nozzle by controlling pressure applied to a nozzle needle of the nozzle in accordance with an electric signal received from an exterior. The physical quantity measurement unit outputs an electric signal in accordance with a physical quantity of high pressure fuel. The first terminal is connected to the pressure control unit. The second terminal connected to the physical quantity measurement unit. The positioning member integrally holds the first terminal and the second terminal and locates the first terminal and the second terminal at predetermined positions. The connector main body portion receives therein the positioning member, and the connector main body portion is made of a resin.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

One embodiment of the present invention will be described below. The fuel injection apparatus is mounted on a cylinder head of an internal combustion engine (not shown), or more specifically, of a diesel engine. The fuel injection apparatus injects high pressure fuel, which is supplied from a common rail (not shown), to a cylinder of the internal combustion engine.

Figure 1:
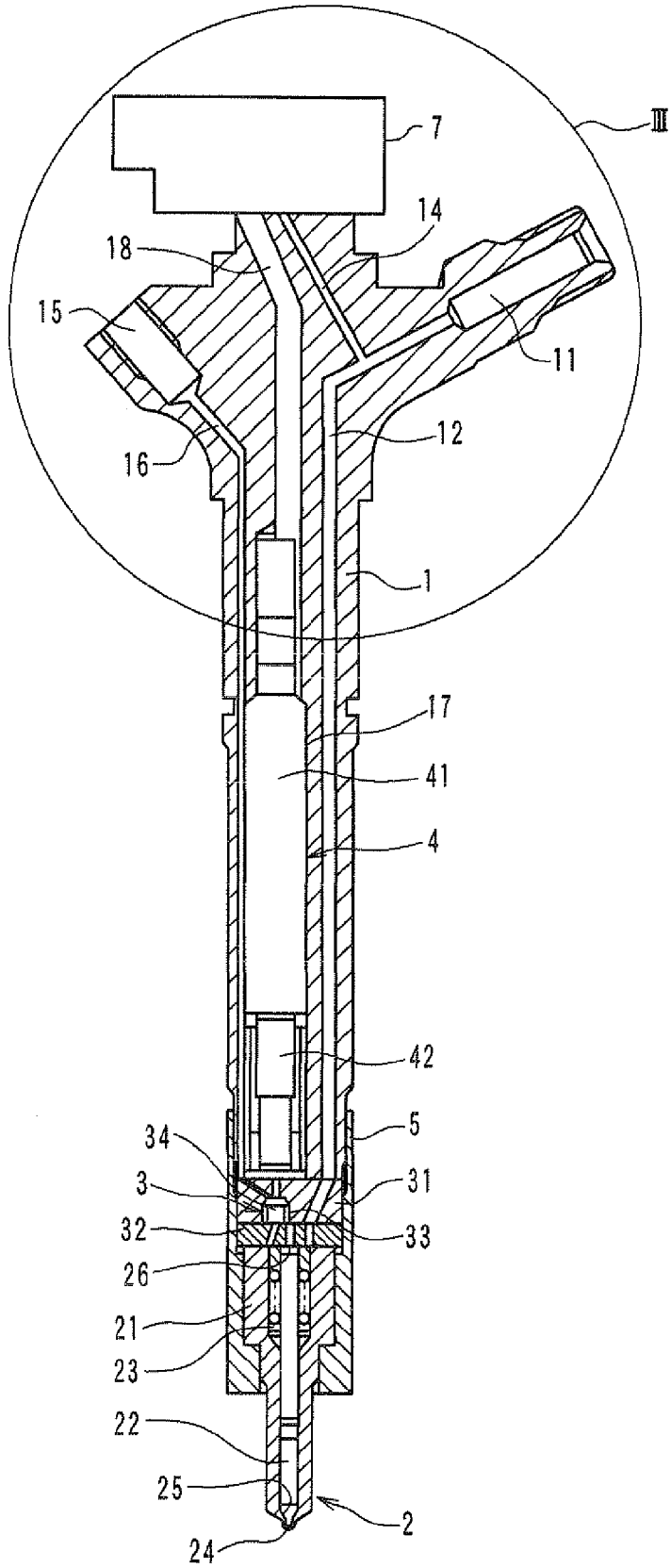
FIG. 1 is a cross-sectional view illustrating a fuel injection apparatus according to one embodiment of the present invention.

As shown in FIG. 1 the fuel injection apparatus has a body 1 that is made by machining a metal material, such as ferrous alloy. The body 1 has a fuel inlet port 11, a high-pressure fuel passage 12, a mount hole 13, a high pressure fuel branch passage 14, a fuel outlet port 15, a low pressure fuel passage 16, a receiving bore 17, and a lead wire hole 18. The fuel inlet port 11 receives high pressure fuel from the common rail. The high-pressure fuel passage 12 leads the high pressure fuel, which is introduced through the fuel inlet port 11, to a nozzle 2 (described later) that is positioned on one longitudinal end of the body 1. The mount hole 13 is formed at the other longitudinal end of the body 1 (see FIG. 3) opposite from the nozzle 2. The high pressure fuel branch passage 14 branches from the high-pressure fuel passage 12 to extends toward the mount hole 13. The fuel outlet port 15 allows fuel to be drained to a fuel tank (not shown). The low pressure fuel passage 16 leads excess fuel in the fuel injection apparatus to the fuel outlet port 15. The receiving bore 17 has a cylindrical shape and receives an actuator 4 (described later). The lead wire hole 18 has a cylindrical shape and allows lead wires 44 of the actuator 4 to extend therethrough to the exterior (see FIG. 3).

The nozzle 2 is provided at the one longitudinal end of the body 1, and injects fuel when the nozzle 2 is opened. The nozzle 2 has a nozzle body 21, a nozzle needle 22, and a nozzle spring 23. The nozzle body 21 has a generally hollow cylindrical shape, and the nozzle body 21 slidably supports therein the nozzle needle 22. The nozzle spring 23 urges the nozzle needle 22 in a valve closing direction for closing the nozzle 2.

The nozzle body 21 has an injection orifice 24 at one longitudinal end, and the injection orifice 24 is communicated with the fuel inlet port 11 through the high-pressure fuel passage 12. High pressure fuel is injected into a cylinder of the internal combustion engine through the injection orifice 24. A tapered valve seat 25 is formed upstream of the injection orifice 24 in the fuel flow direction, and the nozzle needle 22 has a seat portion formed at an end thereof. The seat portion of the nozzle needle 22 is engaged with and disengaged from the valve seat 25 to close and open the injection orifice 24.

The other end portion of the nozzle needle 22 opposite from the injection orifice 24 defines a control chamber 26, fuel pressure in which is changeable between high pressure and low pressure. The nozzle needle 22 is urged in the valve closing direction for closing the nozzle 2 by fuel pressure in the control chamber 26. In contrast, the nozzle needle 22 is urged in a valve opening direction for opening the nozzle 2 by high pressure fuel that is introduced to the injection orifice 24 from the fuel inlet port 11 through the high-pressure fuel passage 12.

A control valve 3 is provided between the body 1 and the nozzle 2, and controls pressure in the control chamber 26. The control valve 3 includes a first plate 31, a second plate 32, and a valve element 34. The first and second plates 31, 32 define therebetween a valve chamber 33, and the valve chamber 33 receives therein the valve element 34. It should be noted that the body 1, the nozzle 2, the first plate 31, and the second plate 32 are connected through a retaining nut 5.

The valve chamber 33 is always communicated with the control chamber 26. Also, it is possible to provide communication between the valve chamber 33 and the low pressure fuel passage 16 and between the valve chamber 33 and the high-pressure fuel passage 12. Specifically, the valve element 34 opens and closes (enables and disables) the communication between the valve chamber 33 and the low pressure fuel passage 16 and the communication between the valve chamber 33 and the high-pressure fuel passage 12.

The actuator 4 actuates the valve element 34 in order to control pressure in the control chamber 26 such that the nozzle 2 is controlled (or is opened and closed). The actuator 4 includes a cylindrical piezo actuator 41 and a transmitter 42. The piezo actuator 41 has multiple piezo elements stacked upon one another, and expands and contracts by electrically charging and discharging the piezo actuator 41. The transmitter 42 transmits the displacement of the piezo actuator 41, which is caused by the expansion and contract of the piezo actuator 41, to the valve element 34. It should be noted that the control valve 3 and the actuator 4 constitute a pressure control unit.

Figure 2:
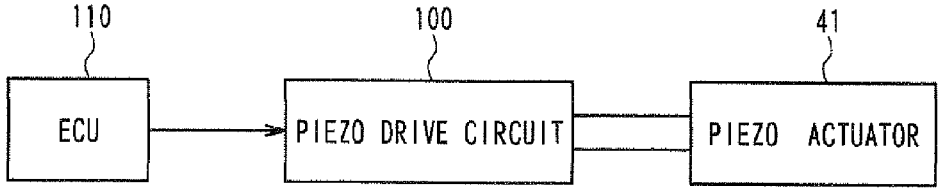
FIG. 2 is a block diagram illustrating an injection control of the fuel injection apparatus.

As shown in FIG. 2, the piezo actuator 41 is provided with electric power through a piezoelectric drive circuit 100. The piezoelectric drive circuit 100 is configured to control voltage applied to the piezo actuator 41 in order to change an expansion amount of the piezo actuator 41. An electronic control circuit 110 (hereinafter, referred as ECU) controls the voltage applied to the piezo actuator 41 by the piezoelectric drive circuit 100 and controls timing of energizing the piezo actuator 41 by the piezoelectric drive circuit 100.

The ECU 110 includes a known microcomputer having a CPU, a ROM, an EEPROM, and a RAM (all of which are not shown), and executes calculation processes based on programs stored in the microcomputer. Also, the ECU 110 receives signals from various sensors (not shown) that detect, for example, an intake air amount, a depressing amount of an accelerator pedal, a rotational speed of the engine, and fuel pressure in the common rail.

Next, the operation of the fuel injection apparatus will be described. Firstly, when the piezo actuator 41 is electrically charged, the piezo actuator 41 expands, and thereby the piezo actuator 41 actuates, through the transmitter 42, the valve element 34 toward the injection orifice 24 (or in the downward direction in FIG. 1). Accordingly, when the valve element 34 is actuated as above, the communication between the valve chamber 33 and the low pressure fuel passage 16 is enabled, and also the communication between the valve chamber 33 and the high-pressure fuel passage 12 is disabled.

As a result, the control chamber 26 is communicated with the low pressure fuel passage 16 through the valve chamber 33, and thereby pressure in the control chamber 26 decreases. Accordingly, the force that urges the nozzle needle 22 in the valve closing direction decreases, and thereby the nozzle needle 22 moves in the valve opening direction. Then, the seat portion of the nozzle needle 22 is disengaged from the valve seat 25, and thereby the injection orifice 24 is opened. In this way, fuel is injected to the cylinder of the internal combustion engine through the injection orifice 24.

When the piezo actuator 41 is electrically discharged later, the piezo actuator 41 contracts, and thereby the valve element 34 is actuated by a spring (not shown) in a direction away from the injection orifice 24 (upward direction in FIG. 1). Then, due to the actuation of the valve element 34, the communication between the valve chamber 33 and the low pressure fuel passage 16 is disabled, and the communication between the valve chamber 33 and the high-pressure fuel passage 12 is enabled.

As a result, the control chamber 26 is communicated with the high-pressure fuel passage 12 through the valve chamber 33, and thereby pressure in the control chamber 26 increases. Accordingly, force that urges the nozzle needle 22 in the valve closing direction increases, and thereby the nozzle needle 22 moves in the valve closing direction. Thus, the seat portion of the nozzle needle 22 contacts the valve seat 25, and thereby the injection orifice 24 is closed to end the fuel injection.

Figure 3:
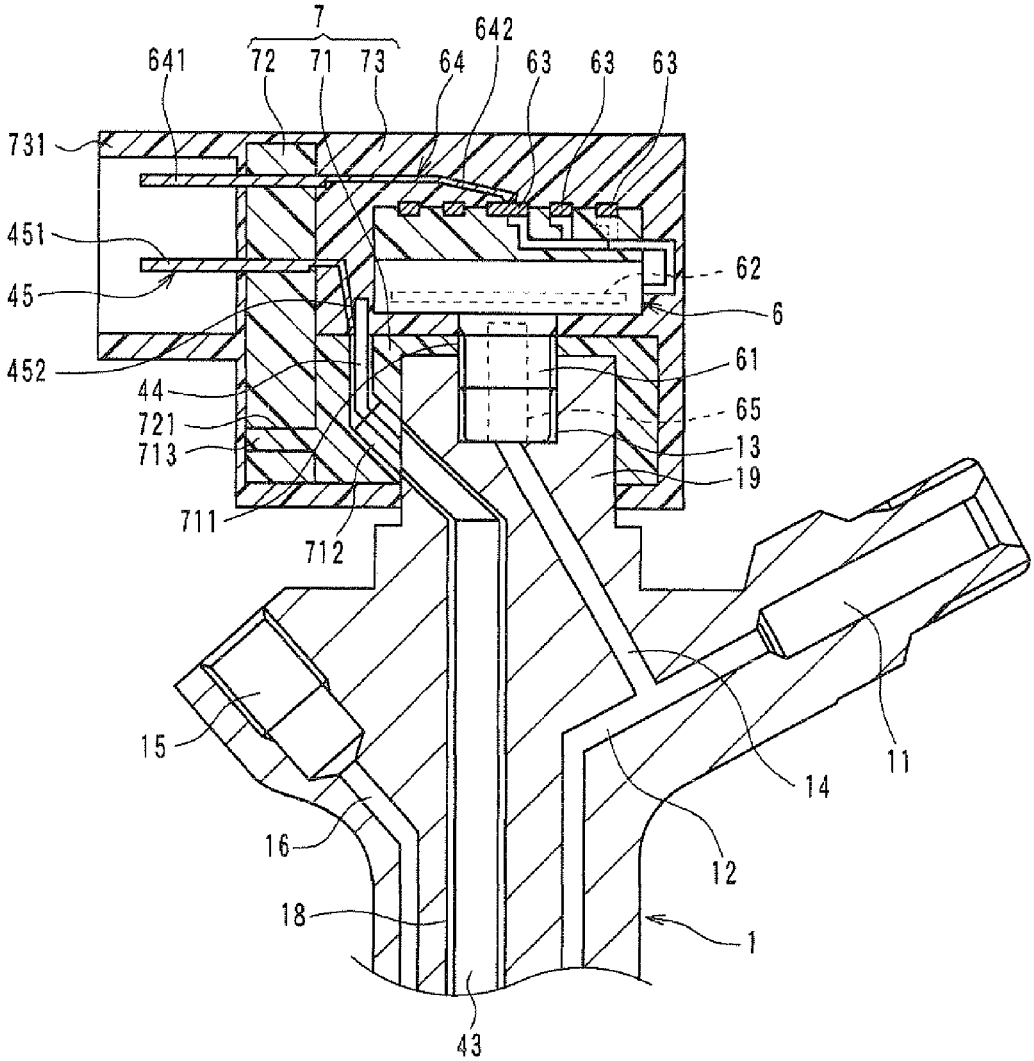
FIG. 3 is an enlarged cross-sectional view of a part III in FIG. 1.

Next, characteristics of the fuel injection apparatus of the present embodiment will be described. As shown in FIG. 3, a pressure sensor 6 is provided at the other longitudinal end of the body 1. The pressure sensor 6 serves as a physical quantity measurement unit that outputs an electric signal in accordance with pressure of high pressure fuel supplied from the common rail.

The pressure sensor 6 has an attachment portion 61 formed with an external (male) threaded member. The mount hole 13 is formed with an internal (female) threaded member. Thus, the attachment portion 61 is threadably engaged with the mount hole 13 such that the pressure sensor 6 is fixed to the body 1. The pressure sensor 6 receives therein a circuit board 62 that is assembled with circuit components, such as a pressure detecting element, a circuit chip. The circuit board 62 is connected with multiple sensor electrodes 63 (three electrodes 63 in the present embodiment), and the sensor electrodes 63 are located on an end surface of the pressure sensor 6 opposite from the attachment portion 61. The sensor electrodes 63 include a circular electrode and two annular electrodes, and the above electrodes 63 are coaxially provided with the circular electrode at the center surrounded by the annular electrodes. Also, the sensor electrodes 63 are connected with sensor terminals 64 (second terminal) that are connected with respective terminals of the external connector (not shown).

Each of the sensor terminals 64 is made of an electrically conductive metal into a plate shape. The sensor terminal 64 has a sensor terminal first plate portion 641 (first part) that is connected with the corresponding terminal (second terminal) of the external connector. Also, the sensor terminal 64 has a sensor terminal second plate portion 642 (second part) that is connected with the sensor electrode 63. The sensor terminal second plate portion 642 has a thickness smaller than a thickness of the sensor terminal first plate portion 641. Specifically, the thickness of the sensor terminal second plate portion 642 may be equal to or less than a half of the thickness of the sensor terminal first plate portion 641.

The attachment portion 61 is a cylindrical cup that defines a sensor hole 65. The pressure detecting element is provided at a vicinity of a bottom portion of the sensor hole 65, and the opening of the sensor hole 65 is communicated with the high pressure fuel branch passage 14. Then, high pressure fuel introduced through the fuel inlet port 11 is lead to the vicinity of the pressure detecting element through the high-pressure fuel passage 12, the high pressure fuel branch passage 14, and the sensor hole 65. Thus, the pressure sensor 6 is capable of outputting the electric signals in accordance with pressure of high pressure fuel.

The pressure sensor 6 is received by a resin connector portion 7. The connector portion 7 includes a cover member 71, a positioning member 72, and a connector main body portion 73.

The cover member 71 has a cup-like shape and includes a cover first hole 711, a cover second hole 712, and a cover projection portion 713. The cover first hole 711 is formed at the bottom portion of the cover member 71, and allows the attachment portion 61 of the pressure sensor 6 to extend therethrough. The cover second hole 712 is formed at the tubular portion of the cover member 71 and allows the two lead wires 44 of the piezo actuator 41 to extend therethrough. The cover projection portion 713 is formed at a position radially outward of the tubular portion. For example, the cover projection portion 713 radially outwardly projects from the tubular portion. The body 1 has a projection tubular portion 19 formed at the end portion of the body 1 remote from the injection orifice 24 and the projection tubular portion 19 has a hollow cylindrical shape. For example, the projection tubular portion 19 projects in the longitudinal direction of the body 1. The cover member 71 is attached to the projection tubular portion 19 of the body 1.

The lead wire hole 18 of the body 1 receives therein a resin bush guide 43 that is formed with two holes for guiding the two lead wires 44 of the piezo actuator 41. The two lead wires 44, which are separately inserted into the respective two holes of the bush guide 43, extend through the cover second hole 712, and the two lead wires 44 has end portions that projects from the cover member 71. It should be noted that the lead wires 44 are electrically insulated by an insulation cover except for the end portions. The lead wires 44 are connected with actuator terminals 45 that are connected with the respective terminal of the external connector.

More specifically, each of the actuator terminals 45 is made of an electrically conductive metal into a plate shape. The actuator terminal 45 (first terminal) has an actuator terminal first plate portion 451 (first part) that is connected with the corresponding terminal (first terminal) of the external connector. Also, the actuator terminal 45 has an actuator terminal second plate portion 452 (second part) that is connected with the respective lead wire 44. The actuator terminal second plate portion 452 has a thickness smaller than a thickness of the actuator terminal first plate portion 451. Specifically, the thickness of the actuator terminal second plate portion 452 may be equal to or less than a half of the thickness of the actuator terminal first plate portion 451.

Figure 4C:
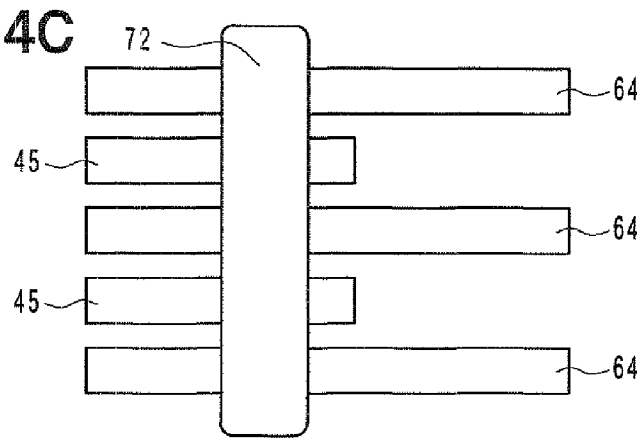
FIG. 4C is a plan view of the positioning member and the terminals observed in direction IVC in FIG. 4A.
Figure 4A:
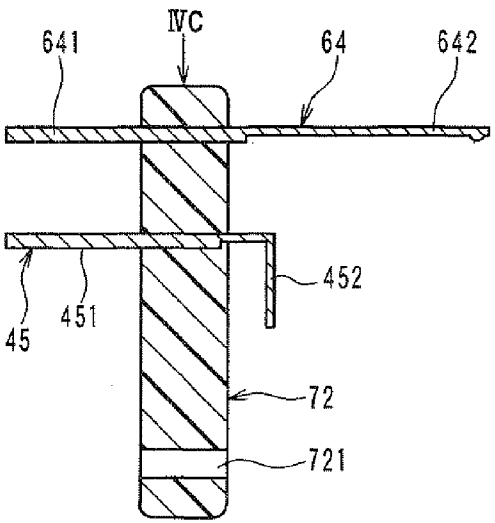
FIG. 4A is a front cross-sectional view illustrating a positioning member and terminals in FIG. 3 and is taken along a line IVA-IVA in FIG. 4B.
Figure 4B:
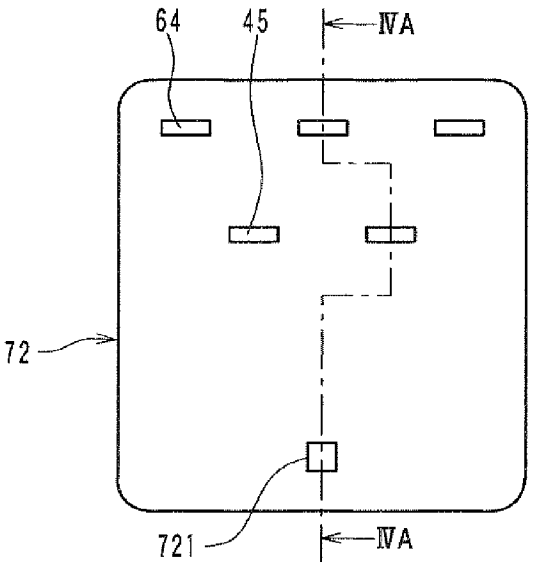
FIG. 4B is a left side view of the positioning member and the terminals in FIG. 4A.

As shown in FIG. 3, FIG. 4A to FIG. 4C, the positioning member 72 is a rectangular parallelepiped, and has a positioning bore 721 that is fitted with the cover projection portion 713. Also, the sensor terminals 64 and the actuator terminals 45 are insert molded into the positioning member 72 such that the sensor terminals 64 and the actuator terminals 45 are integral with the positioning member 72. In other words, the positioning member 72 integrally holds the sensor terminals 64 and the actuator terminals 45 and locates the sensor terminals 64 and the actuator terminals 45 at predetermined positions. As shown in FIGS. 4A to 4C, the actuator terminals 45 (first terminals) are positioned and extend on a first plane, and the sensor terminals 64 (second terminals) are positioned and extend on a second plane. The first plane is spaced away from the second plane by a predetermined distance therebetween, and the first plane is in parallel with the second plane.

As shown in FIG. 3, the pressure sensor 6, the cover member 71 and the positioning member 72 are insert molded into the connector main body portion 73. Also, the connector main body portion 73 has a tubular connector housing portion 731 that is fitted with the external connector. Parts of the sensor terminal first plate portions 641 and parts of the actuator terminal first plate portions 451 are uncovered within the connector housing portion 731.

Next, the assembly procedure of the pressure sensor 6 and the connector portion 7 to the body 1 is described.

Firstly, as shown in FIG. 3, the cover member 71 is assembled to the projection tubular portion 19 of the body 1. Next, the two lead wires 44 are pulled out of the cover second hole 712. Then, the pressure sensor 6 is threadably fixed to the body 1.

Figure 5:
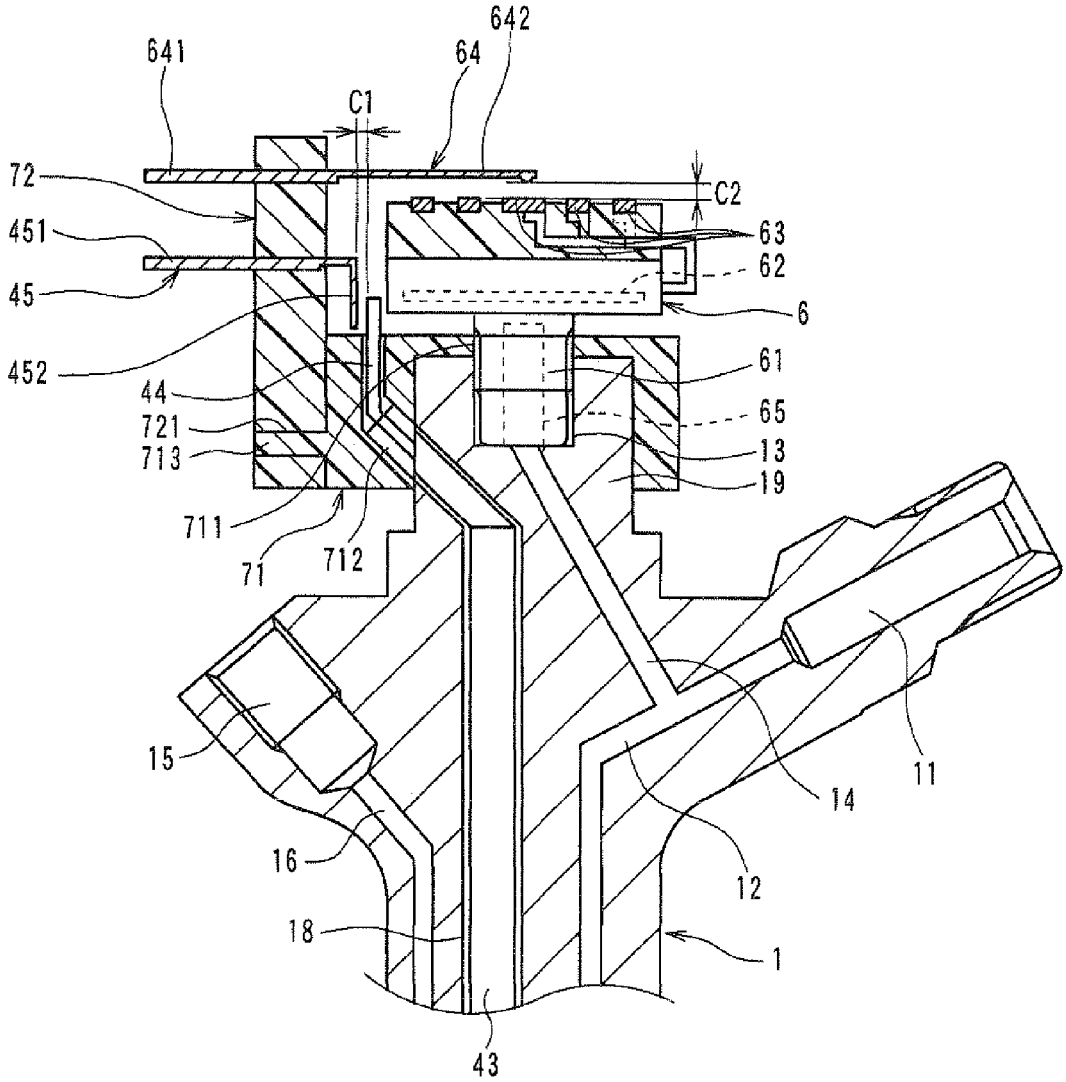
FIG. 5 is a cross-sectional view illustrating a certain step in a manufacture process of the fuel injection apparatus.
Figure 6:
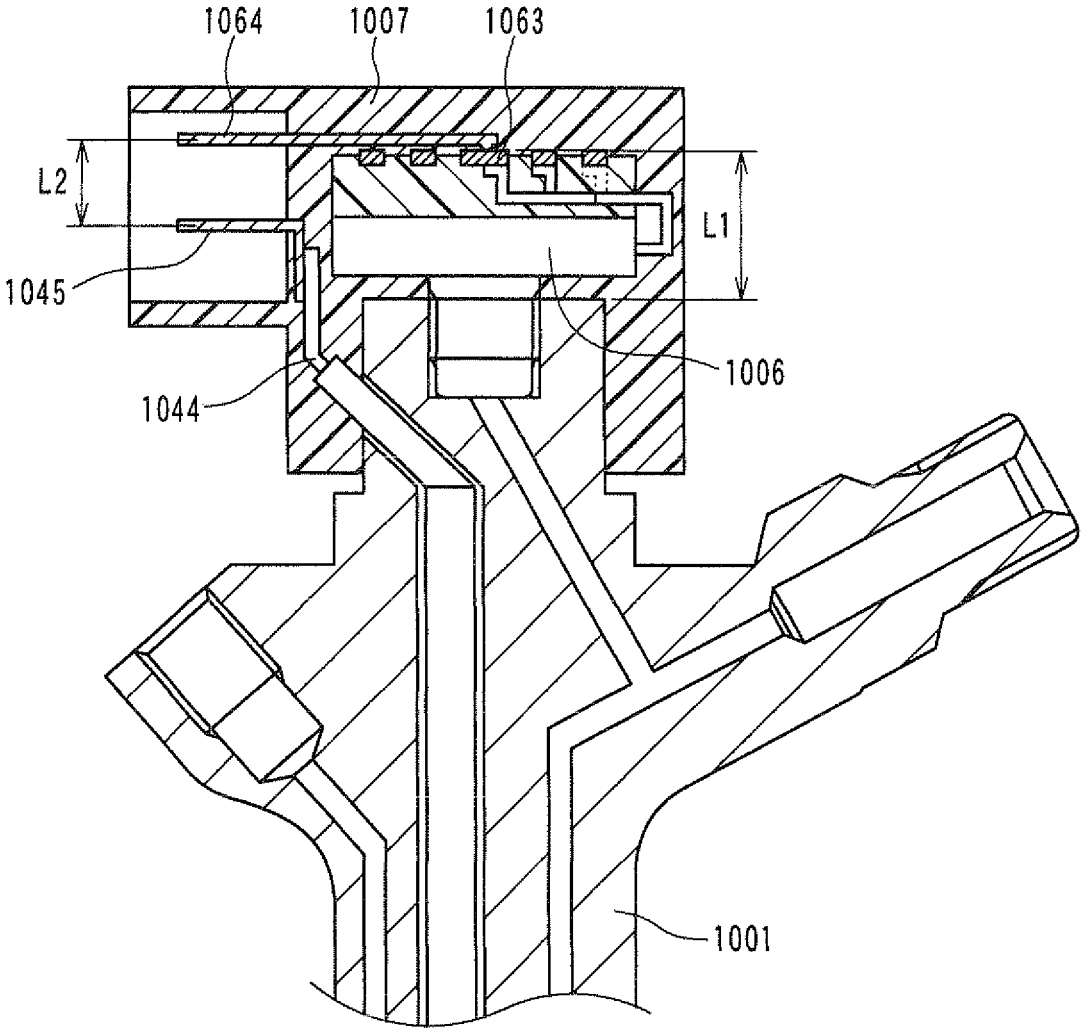
FIG. 6 is a cross-sectional view of a comparison example of a fuel injection apparatus.

Next, the cover projection portion 713 is press-fitted into the positioning bore 721 in order to fix the positioning member 72 to the cover member 71. When the positioning member 72 is brought into fixation to the cover member 71 as shown in FIG. 5, a clearance C1 is surely to be formed between the lead wire 44 and the actuator terminal second plate portion 452. Also, a clearance C2 is also surely to be formed between the sensor electrodes 63 and the sensor terminal second plate portion 642.

In the above state, where the clearance C1 is formed, the actuator terminal second plate portion 452 is deformed or bent in order to bring the actuator terminal second plate portion 452 into contact with the lead wire 44. Then, the lead wire 44 is connected to the actuator terminal second plate portion 452 by welding, for example. Also, in the above state, where the clearance C2 is formed, the sensor terminal second plate portion 642 is deformed or bent in order to bring the sensor terminal second plate portion 642 into contact with the sensor electrodes 63. Then, the sensor electrodes 63 is connected to the sensor terminal second plate portion 642 by welding. Thus, after the welding, the actuator terminal second plate portion 452 and the sensor terminal second plate portion 642 are curved to connect with the actuator 4 (pressure control unit) and the pressure sensor 6 (physical quantity measurement unit), respectively.

Next, the connector main body portion 73 is formed by insert molding such that the pressure sensor 6, the cover member 71, and the positioning member 72 are located within the connector main body portion 73 as shown in FIG. 3. Thus, the connector main body portion 73 receives therein the positioning member 72.

In the present embodiment, the positioning member 72 holds and locates the sensor terminals 64 and the actuator terminals 45 at the respective predetermined positions. As a result, the sensor terminal first plate portion 641 and the actuator terminal first plate portion 451, which are connected with the respective terminals of the external connector, are accurately positioned relative to each other advantageously.

Also, in the present embodiment, the actuator terminal second plate portion 452 has the relatively thinner thickness. As a result, during the connecting of the lead wire 44 with the actuator terminal second plate portion 452 by the welding, the actuator terminal second plate portion 452 is easily brought into contact with the lead wire 44 by deforming the actuator terminal second plate portion 452. Similarly, the sensor terminal second plate portion 642 also has the relatively thinner thickness. As a result, during the connecting of the sensor electrode 63 with the sensor terminal second plate portion 642 by the welding, the sensor terminal second plate portion 642 is easily brought into contact with the sensor electrode 63 by deforming the sensor terminal second plate portion 642.

In the above embodiment, the piezo actuator 41 is employed as an actuation element of the actuator 4. However, a solenoid may be employed as the actuation element instead of the piezo actuator 41 such that an electromagnetic attractive force of the solenoid alternatively actuates the valve element 34 of the control valve 3.

Also, in the above embodiment, the present invention is applied to the fuel injection apparatus having the pressure sensor 6. However, the present invention may be alternatively applied to a fuel injection apparatus having a temperature sensor. In the above alternative case, the temperature sensor serves as a physical quantity measurement unit that outputs electric signals in accordance with temperature of high pressure fuel supplied from the common rail.

Additional advantages and modifications will readily occur to those skilled in the art. The invention in its broader terms is therefore not limited to the specific details, representative apparatus, and illustrative examples shown and described.

What is claimed is:

1. A fuel injection apparatus comprising:

a body having a high-pressure fuel passage that allows high pressure fuel to flow therethrough;

a nozzle having an injection orifice that allows high pressure fuel to be injected therethrough when the nozzle is opened;

a pressure control unit that controls opening and closing of the nozzle by controlling pressure applied to a nozzle needle of the nozzle in accordance with an electric signal received from an exterior;

a physical quantity measurement unit that outputs an electric signal in accordance with a physical quantity of high pressure fuel;

a first terminal connected to the pressure control unit;

a second terminal connected to the physical quantity measurement unit;

a positioning member that integrally holds the first terminal and the second terminal and locates the first terminal and the second terminal at predetermined spaced apart positions; and a connector main body portion that receives therein the positioning member, the connector main body portion being made of a resin, wherein:

the positioning member is a separate component from the connector main body portion that is received in the connector main body portion.

2. The fuel injection apparatus according to claim 1, wherein:

the first terminal has a first part connected to a first terminal of an external connector and has a second part connected to the pressure control unit, the first part of the first terminal having a thickness greater than a thickness of the second part of the first terminal; and the second terminal has a first part connected to a second terminal of the external connector and has a second part connected to the physical quantity measurement unit, the first part of the second terminal having a thickness greater than a thickness of the second part of the second terminal.

3. The fuel injection apparatus according to claim 1, further comprising:

a cover member that covers an end portion of the body remote from the nozzle, the cover member having a projection portion, wherein:

the positioning member is a flat plate; and the positioning member has a positioning bore that is fitted with the projection portion of the cover member.

4. The fuel injection apparatus according to claim 1, wherein:

the second part of the first terminal is curved to be connected to the pressure control unit; and the second part of the second terminal is curved to be connected to the physical quantity measurement unit.

5. The fuel injection apparatus according to claim 1, wherein:

the first terminal is one of a plurality of first terminals that are positioned on a first plane;

the second terminal is one of a plurality of second terminals that are positioned on a second plane;

the first plane is spaced away from the second plane by a predetermined distance therebetween; and the first plane is in parallel with the second plane.

6. The fuel injection apparatus according to claim 1, wherein:

the positioning member is mounted to the body in a state where the first terminal and the second terminal are fixed to the positioning member.

7. The fuel injection apparatus according to claim 6, wherein:

the positioning member, integrally holding the first terminal and the second terminal, is indirectly mounted to the body.

8. The fuel injection apparatus according to claim 1, wherein:

the positioning member is encapsulated by the resin of the connector main body portion.

9. The fuel injection apparatus according to claim 1, further comprising:

a cover member that covers an end portion of the body remote from the nozzle, wherein:

the positioning member is fixed to the cover member in a state where the first terminal and the second terminal are fixed to the positioning member.

10. The fuel injection apparatus according to claim 9, wherein:

the physical quantity measurement unit, the cover member, and the positioning member are insert-molded into the connector main body portion.

11. A fuel injection apparatus comprising:

a body having a fuel passage that allows fuel to flow therethrough;

a nozzle having an injection orifice that allows fuel to be injected therethrough when opened;

a pressure control unit that controls opening and closing of the nozzle by controlling pressure applied to a nozzle needle of the nozzle in accordance with an external electric signal;

a physical quantity measurement unit that outputs a detection signal in accordance with a physical quantity of fuel;

a first terminal connected to the pressure control unit to conduct the external electric signal;

a second terminal connected to the physical quantity measurement unit to conduct the detection signal;

a positioning member that is mounted to the body; and a connector main body portion that is molded from resin, wherein:

the positioning member is a separate component from the connector main body portion, and the positioning member is insert-molded into the connector main body portion in a state where the first terminal and the second terminal are fixed to the positioning member to locate the first terminal and the second terminal at predetermined positions.

12. The fuel injection apparatus according to claim 11, further comprising:

a cover member that is located between the body and the positioning member, the cover member covering an end portion of the body remote from the nozzle.

* * * * *